US010738441B2

(12) United States Patent
Lindskov

(10) Patent No.: US 10,738,441 B2
(45) Date of Patent: Aug. 11, 2020

(54) MEASURING EQUIPMENT FOR DETERMINING THE RESULT OF EARTHMOVING WORK

(71) Applicant: LEICA GEOSYSTEMS TECHNOLOGY A/S, Odense SØ (DK)

(72) Inventor: Anders Lindskov, Ebberup (DK)

(73) Assignee: LEICA GEOSYSTEMS TECHNOLOGY A/S, Odense Sø (DK)

( * ) Notice: Subject to any disclaimer, the term of this patent is extended or adjusted under 35 U.S.C. 154(b) by 137 days.

(21) Appl. No.: 16/083,506

(22) PCT Filed: Mar. 9, 2017

(86) PCT No.: PCT/DK2017/000002
§ 371 (c)(1),
(2) Date: Sep. 8, 2018

(87) PCT Pub. No.: WO2017/152916
PCT Pub. Date: Sep. 14, 2017

(65) Prior Publication Data

US 2019/0071845 A1 Mar. 7, 2019

(30) Foreign Application Priority Data

Mar. 9, 2016 (DK) ..... 2016 00147

(51) Int. Cl.
*E02F 9/26* (2006.01)
*E02F 9/20* (2006.01)
*E02F 3/32* (2006.01)

(52) U.S. Cl.
CPC ..... *E02F 9/2004* (2013.01); *E02F 9/2029* (2013.01); *E02F 9/26* (2013.01); *E02F 9/264* (2013.01); *E02F 3/32* (2013.01)

(58) Field of Classification Search
CPC ..... E02F 3/28; E02F 9/26
USPC ..... 37/348
See application file for complete search history.

(56) References Cited

U.S. PATENT DOCUMENTS 4,343,099 A * 8/1982 Ziegler ..... E02F 3/437 37/443
4,452,078 A 6/1984 Formanek et al.
5,682,311 A 10/1997 Clark
5,701,691 A 12/1997 Watanabe et al.
(Continued)

FOREIGN PATENT DOCUMENTS

EP 0412398 A1 2/1991
JP S56 105030 A 8/1981
(Continued)

OTHER PUBLICATIONS

DK Search Report in application No. PA 2016 00147 dated Nov. 17, 2016.
(Continued)

*Primary Examiner* — Gary S Hartmann
(74) *Attorney, Agent, or Firm* — Maschoff Brennan

(57) ABSTRACT

The result of working with an earth moving machine comprising a bucket may be determined using known dimensions of the bucket combined with determinations of the depth of cutting and the horizontal travel or accumulated length of horizontal travel. The depth of cutting is determined by using the bucket as a receptacle as well as a depth sensor.

6 Claims, 2 Drawing Sheets

(56) References Cited

U.S. PATENT DOCUMENTS

| | | | | |
|---|---|---|---|---|
| 5,960,378 | A | 9/1999 | Watanabe et al. | |
| 6,085,583 | A | 7/2000 | Cannon et al. | |
| 6,819,993 | B2 * | 11/2004 | Koch | E02F 3/435 37/348 |
| 7,669,354 | B2 * | 3/2010 | Aebischer | E02F 9/264 37/348 |
| 10,208,459 | B2 * | 2/2019 | Matsuo | G01B 11/00 |
| 2004/0158355 | A1 | 8/2004 | Holmqvist et al. | |
| 2006/0026101 | A1 | 2/2006 | Ogura et al. | |
| 2008/0005938 | A1 | 1/2008 | Aebischer et al. | |
| 2008/0319710 | A1 | 12/2008 | Hsu et al. | |
| 2010/0161184 | A1 | 6/2010 | Marathe et al. | |
| 2012/0191431 | A1 | 7/2012 | Dunababin et al. | |
| 2015/0240458 | A1 | 8/2015 | Nagato et al. | |
| 2015/0276468 | A1 | 10/2015 | Jaeger | |
| 2018/0120098 | A1 * | 5/2018 | Matsuo | E02F 9/264 |
| 2019/0026914 | A1 * | 1/2019 | Hageman | E02F 9/264 |
| 2020/0087893 | A1 * | 3/2020 | Hageman | E02F 3/32 |

FOREIGN PATENT DOCUMENTS

| | | | |
|---|---|---|---|
| JP | S57 66239 | A | 4/1982 |
| WO | 2015/166210 | A1 | 11/2015 |

OTHER PUBLICATIONS

Sanjiv Singh and Alonzo Kelly, "Robot planning in the space of feasible actions: Two examples", Proceedings of the 1996 IEEE, International Conference on Robotics and Automation, Apr. 1996, p. 3309-3316, Section 5.

* cited by examiner

MEASURING EQUIPMENT FOR DETERMINING THE RESULT OF EARTHMOVING WORK

FIELD

The embodiments discussed herein relate to measuring equipment, which when combined with operational components of earth moving equipment comprising a bucket or corresponding earth holding implements enables the determination of the volume of earth removed from a predetermined area.

BACKGROUND

Earth moving equipment is used in transforming natural soil in a geographical location with a pre-existing local topology into a new local topology. The subject matter claimed herein is not limited to embodiments that solve any disadvantages or that operate only in environments such as those described above. Rather, this background is only provided to illustrate one example technology area where some embodiments described herein may be practiced.

SUMMARY

Equipment may include buckets or similar digging containers, which are joined to arms or levers, or linkages, which are again joined to other levers or linkages, which are made operational by hydraulic cylinders for rotating them about their respective joints or varying their lengths, including hydraulic cylinders for moving those levers (frequently termed 'booms') that are directly joined to the chassis of the earth moving equipment. A bucket is moved by corresponding hydraulic means.

In the present text 'earth' is intended to mean the natural ground upon which the earth moving equipment works, and it comprises clay, gravel, stones, and rocks in their dry or wet state, but not solid rock. It is also intended to cover any filling material that the equipment may be used to distribute according to a given schedule.

In the present text the expression 'the outermost lever' is intended to mean the lever that carries the bucket or a similar digging container in an articulated hydraulically operated chain of levers connected to the chassis of the earth moving equipment. The outermost lever is indicated in the drawings.

In the present text the expression 'the vertical ground distance' is intended to mean the calculated vertical distance to ground of a distance measuring device placed at a predetermined point of the outermost lever, calculated by means of an apparent distance measured at an angle, said angle being known by means of an inclination sensor. The vertical ground distance is indicated in the drawings.

Expert operators may work with such earth moving equipment in order to transform the local topology according to set plans, and they are aided by measuring equipment systems that provide information about the implements that are directly engaging the ground. In operations removing earth there is a particular emphasis on knowing the depth of the implement with respect to a reference, either to the surrounding surface or to a computerised model of the topography. In the latter case it may be either a model of the topography as is or the topography to be obtained.

The depth may be an example parameter when it is desired to determine the volume of material removed either to monitor progress or to supply logistic information to the support in the form of transportation vehicles.

With the lengths of the levers and the angles between them known at any one instant, it is possible to refer any end point of a lever to the chassis of the earth moving equipment. If the earth moving equipment is fitted with an absolute position reference via any of the conventional systems (GNSS or local total station or the similar) it is possible to refer any end point of a lever to an absolute reference. In order to determine the depth of an implement (a bucket or similar digging container) fitted to the endpoint of the utmost lever with respect to any of the references mentioned, it may be necessary or beneficial (while in other embodiments not necessary and/or beneficial) to know the implement's lowermost point at any one instant and the distance of that point from the endpoint of the utmost lever.

Similar problems are encountered in the field of robotics, where the end of an implement has to be controlled very precisely as it moves in space in order to perform the desired operation. However, the known solutions are very different from those that can be universally applied in the field of earth moving technology. First of all, the precision is at least one order of magnitude higher in the field of robotics, and secondly the environment for a robotic system working indoors is much less demanding than the environment in which earth moving equipment is used.

For this reason, robotic equipment is for instance frequently fitted with precision angle encoders at each joint, and trigonometric relations are used to calculate with high precision the position of a particular part with reference to a coordinate system that includes the robotic equipment and the real world it is operating in. Angle encoders may be useful in earth moving equipment, but due to their environmental sensitivity, they are frequently enclosed in the joints between levers, and this is done at the time of construction of the earth moving equipment. Retrofitting angle encoders to pre-existing earth moving equipment may require constructions that are water and dust proof. This would mean that in order to obtain the functionality of e.g. depth and volume determination with older, but technically sound mechanical constructions, some parts of these constructions would have to be replaced. According to some embodiments of the present disclosure, component parts of relevant measuring equipment may be retrofitted as well as installed on factory-new earth moving equipment.

According to some embodiments of the present disclosure, a practical solution to the above problem is obtained in measuring equipment that is fitted to the outermost lever and the digging bucket of earth moving equipment, the instant end position of said outermost lever being calculated from pre-installed inclination and length determining instrumentation, said measuring equipment comprising a ground distance sensor fitted to the outermost lever and an inclination sensor fitted to the digging bucket, the volume determination being based on:

- the bucket dimensions and orientation,
- a vertical ground distance calculated from the position of a predetermined point of the outermost lever and the ground distance measured, and/or
- the horizontal distance travelled by the bucket as determined by signals from the pre-installed inclination and length determining instrumentation.

In an example embodiment of the present disclosure, the predetermined point of the outermost lever is the end point of said lever. This is the point to which the bucket is fitted and around which it is pivoted to move.

Another example embodiment of the present disclosure is particular in that a separate inclination sensor is fitted to the outermost lever in a known angular relationship to the orientation of the ground distance sensor, and in that the instant angle measured is used to obtain the vertical ground distance. A measure of this distance is hence obtained independent of the information provided by other sensors in the chain of levers constituting the digging equipment.

A further example embodiment of the present disclosure is particular in that the inclination of the outermost lever is determined trigonometrically by means of extension sensors for the piston rods of operational hydraulic cylinders manipulating the earth moving equipment. In certain earth moving equipment, the determination of the angular position of a given lever may be obtained by trigonometric calculation based on the geometrical position of the points of attack of the hydraulic cylinders used to move the levers with respect to each other, the geometrical position of the joints of the levers, and on the instant extension of each piston rod as determined by built-in extension determining sensors. A stick is merely a lever that may be longer or shorter according to the extension of a piston rod, and its angular position is not changed thereby.

The distance measuring instrument may be a retroreflective laser sensor because it is better adapted to provide precise data without compensation for e.g., humidity and temperature that would be required for an ultrasound sensor.

Some embodiments of the present disclosure comprise use of the above equipment in order for calculating the amount of material removed by the bucket, either individually for one bucket or accumulated over a period of work. The measurements may be made continuously as the work progresses, and may mean that many data samples per second are created to base the calculations on.

BRIEF DESCRIPTION OF THE DRAWINGS

Example embodiments will be described and explained with additional specificity and detail through the use of the accompanying drawings in which.

Figure 1:
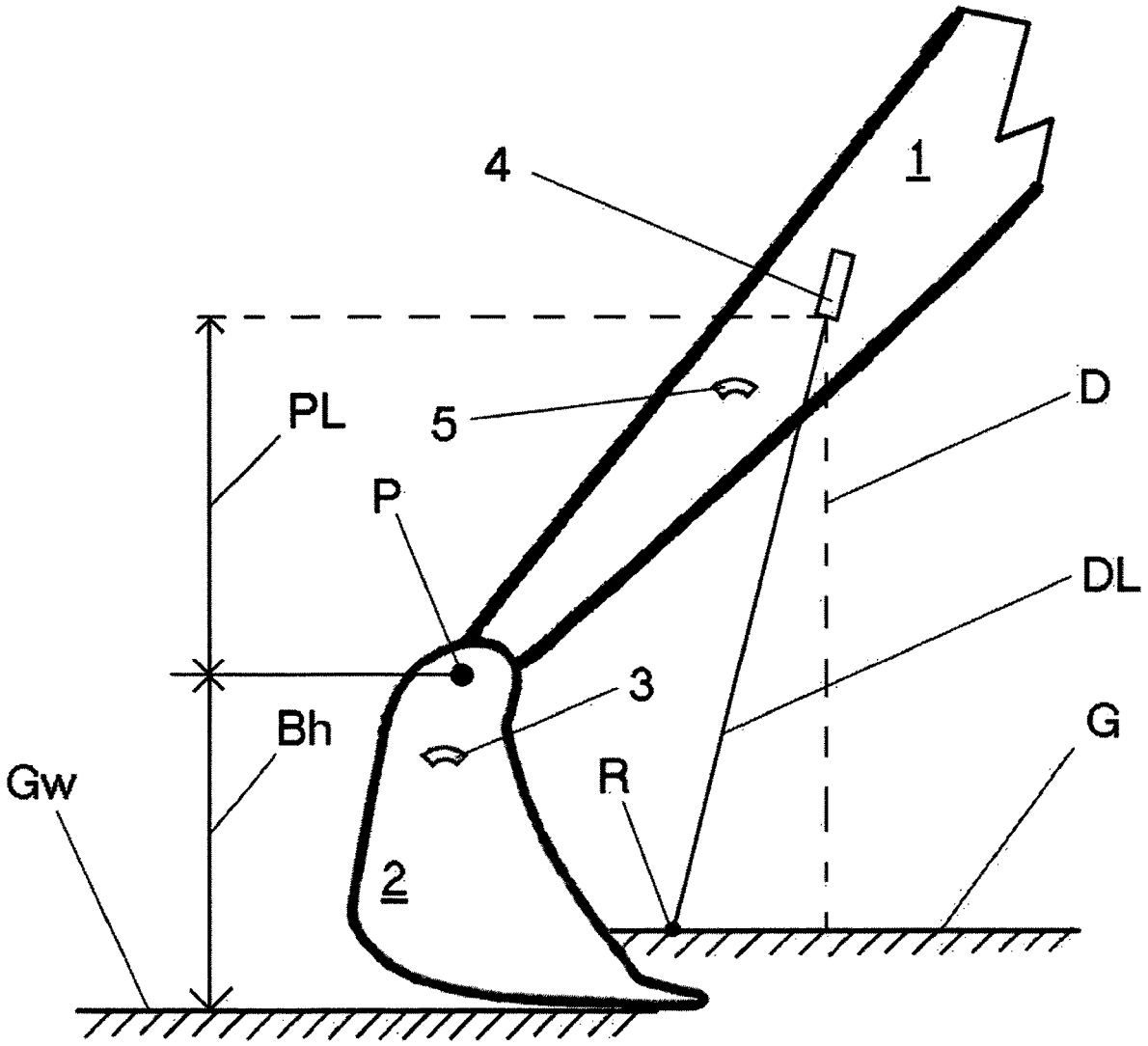
FIG. 1 shows a simplified section of the chain of levers that carries a bucket.

The individual items shown in the drawings and referred to in the claims are merely examples of items that function in the given environment, and the skilled person will be able to devise combinations that function in the same way in order to obtain the inventive result.

DESCRIPTION OF EMBODIMENTS

In FIG. 1 is shown a stick 1 of an earth moving machine, which is hydraulically operated as to its extension and its angular relationship to a boom. The various hydraulic cylinders and joints that are well-known in the trade are not shown in this drawing. The stick carries a bucket 2 that is capable of digging and holding earth, which is pivotable around a pivot P by means of hydraulics. The bucket is provided with an inclination sensor 3, and the stick 1 is provided with a laser distance measuring instrument 4 that measures the distance to a point R on the ground. The inclination sensor 3 is shown symbolically by a shape reminiscent of a spirit level but may be of any type delivering an electric output at a useful rate. The stick is furthermore provided with an inclination sensor 5. These sensors are firmly fitted to the stick, and this may be done at any time of the lifetime of the earth moving machine, i.e. they may be retrofitted in order to give a machine an advantage of the present disclosure. The laser distance measuring instrument 4 measures the distance DL by retro-reflection from a point R hit by the laser beam, and this is converted in a calculator into the vertical distance D to the ground G from the laser window, based upon the indication of the inclination sensor 5. The inclination sensor 5 is also shown symbolically by a shape reminiscent of a spirit level but may be of any type delivering an electric output at a useful rate.

The bucket is used both as a receptacle and as a measuring implement. In order to calculate the volume of the earth that is held at any one instant it is necessary to know the width of the bucket, the depth it is digging into the ground at any one instant and the length the bucket has travelled since it started digging. The depth is the difference between the level of the ground G before working and the level Gw after working. The distance after working may be calculated by means of the distance Bh between the bottom of the bucket 2 and the pivot P, and the knowledge of the position of the pivot P. This, in its turn, may be calculated by means of the fixed measurements of the position of the laser distance measuring instrument 4 with respect to the pivot P and the inclination data provided by the inclination sensor 5 The depth may hence be calculated as the sum of the distance Bh and the distance DL, from which is subtracted the distance D.

Some lengths are defined by the constructional elements and points of attack by the hydraulic cylinders on these constructional elements and the extension at any given instant of the respective piston rods, and some angles may be obtained from angle encoders built-in at the time of construction of the machine. The lengths are sufficient to enable a calculation by trigonometric and geometric calculating units the position of any pivot, such as the outer joint of the outermost lever with respect to global coordinates obtained from a GNSS. If angle measurements are available, either in the form of the output of angle encoders or in the form of outputs from inclination sensors the same trigonometric and geometric approaches apply.

Figure 2:
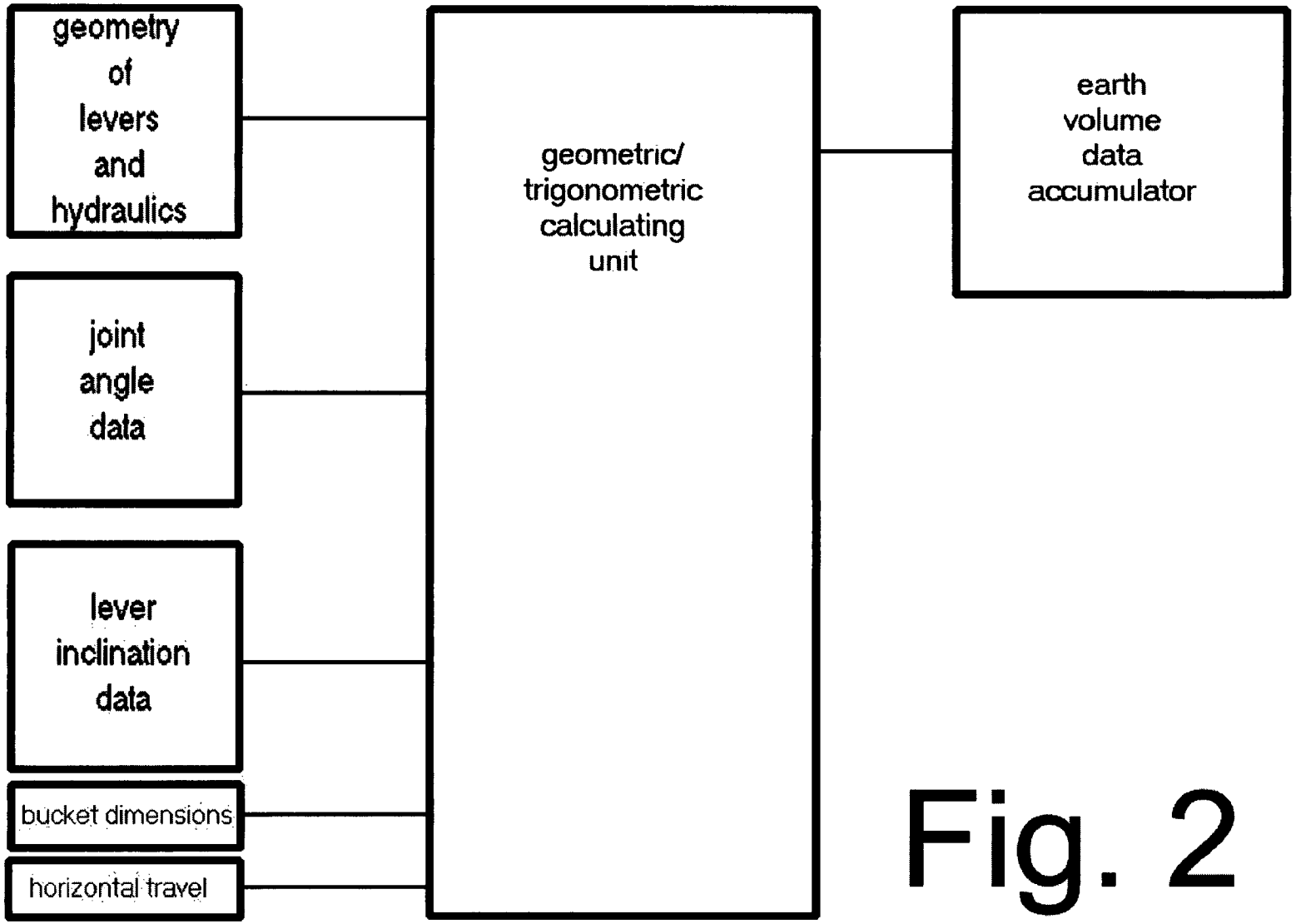
FIG. 2 shows a block diagram of data and calculating units.

FIG. 2 shows a schematic representation of data sources and a calculating unit containing trigonometric calculating functions for determining the depth of digging by the bucket 2 shown in FIG. 1. As described in connection with FIG. 1 this depth may be determined via data related to the specific geometry of the earth moving equipment, and this is one set of data input to the calculating unit. Another set of data comprises data related to the joints between the levers, which may be obtained by angle encoders, either built into the equipment at the time of its manufacture or retrofitted. A third set of data is obtained from inclinometers on the various levers included in the linkage of the earth moving equipment, which may be retrofitted to the equipment. This data as well as information on the bucket dimensions and its horizontal travel as it is filled with earth that is removed is combined in the calculating unit, having as its output the accumulated volume of earth removed. This means that it is possible to let the earth moving equipment work until a given limit is reached, such as reliable filling of a lorry or truck for transportation of the earth.

In accordance with common practice, the various features illustrated in the drawings may not be drawn to scale. The illustrations presented in the present disclosure are not meant to be actual views of any particular apparatus (e.g., device, system, etc.) or method, but are merely idealized representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used in the present disclosure and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used in the present disclosure to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

All examples and conditional language recited herein are intended for pedagogical objects to aid the reader in understanding the present disclosure and the concepts contributed by the inventor to furthering the art, and are to be construed as being without limitation to such specifically recited examples and conditions. Although embodiments of the present disclosure have been described in detail, it should be understood that the various changes, substitutions, and alterations could be made hereto without departing from the spirit and scope of the present disclosure.

The invention claimed is:

1. Measuring equipment comprising:

operational components of earth moving equipment that comprise an earth holding implement, which enables a volume determination of a volume of earth removed from a pre-determined area, said measuring equipment being fitted to an outermost lever and the earth holding implement of the earth moving equipment, an instant end position of said outermost lever being calculated from a pre-installed inclination and length determining instrumentation;

a ground distance sensor fitted to the outermost lever;

an inclination sensor fitted to the earth holding implement; and a calculating unit for the volume determination based on information relating to:

dimensions and orientation of the earth holding implement, a vertical ground distance calculated from a position of a predetermined point of the outermost lever and a ground distance measured, and a horizontal distance travelled by the earth holding implement as determined by signals from the pre-installed inclination and length determining instrumentation.

2. Measuring equipment according to claim 1, wherein the predetermined point of the outermost lever is an end point of said outermost lever.

3. Measuring equipment according to claim 1 further comprising an inclination sensor fitted to the outermost lever in a known angular relationship to the orientation of the ground distance sensor, and wherein an instant angle measured is used to obtain the vertical ground distance.

4. Measuring equipment according to claim 1, wherein an inclination of the outermost lever is determined trigonometrically by means of extension sensors for piston rods of operational hydraulic cylinders manipulating the earth moving equipment.

5. Measuring equipment according to claim 1, wherein the ground distance sensor is a retroreflective laser sensor.

6. A method of operating the measuring equipment of claim 1 determining a volume of earth removed by means of the a bucket or similar earth holding implement, the method comprising:

a) a calibration phase in which a maximum ground distance is determined as a first item of information while the earth holding implement is placed on the ground supported by the outermost lever and whereby the pre-installed inclination of the earth holding implement and the pre-installed inclination of the outermost lever are used as second and third items of information respectively, the calculating unit used for setting a zero-depth status, and b) a continuous measurement phase, during which the earth holding implement digs into the ground and is filled with earth, while the vertical earth distance and the horizontal distance travelled are calculated by the calculating unit by means of the items of information obtained from the sensors.

* * * * *